US007060884B2

(12) United States Patent
Bryson

(10) Patent No.: US 7,060,884 B2
(45) Date of Patent: Jun. 13, 2006

(54) STRING STRETCHER FOR STRINGED INSTRUMENTS

(76) Inventor: Alan Campbell Bryson, 1901 Augusta Dr. #152, Houston, TX (US) 77057

( * ) Notice: Subject to any disclaimer, the term of this patent is extended or adjusted under 35 U.S.C. 154(b) by 267 days.

(21) Appl. No.: 10/794,364

(22) Filed: Mar. 5, 2004

(65) Prior Publication Data

US 2005/0211066 A1 Sep. 29, 2005

(51) Int. Cl.
*G10G 7/02* (2006.01)

(52) U.S. Cl. ..... 84/455

(58) Field of Classification Search ..... 84/453, 84/454, 455, 457, 459
See application file for complete search history.

(56) References Cited

U.S. PATENT DOCUMENTS 6,107,556 A 8/2000 Gilliam

OTHER PUBLICATIONS http://www.planetwaves.com/tools_product_4.asp.
http://www.stringthis.com/stringthis/pegwindelpla.html.

*Primary Examiner*—Kimberly Lockett
(74) *Attorney, Agent, or Firm*—Law Office of Alan Bryso

(57) ABSTRACT

A string stretcher has a body with a stretcher axis of rotation about which to rotate the string stretcher when positioned transverse to the fingerboard. At least one support member has an upwardly facing support surface for selectively urging and holding the selected string above the fingerboard. A first stretching member has a first stretching surface spaced from the stretcher axis of rotation for contacting the selected string at a first string location to urge the selected string across the fingerboard in a first direction during rotation. A second stretching member has a second stretching surface oppositely facing with respect to the first stretching surface, for contacting the selected string at a second string location opposite the stretcher axis of rotation from the first stretching surface to urge the selected string across the fingerboard in a second direction substantially opposite the first direction.

25 Claims, 8 Drawing Sheets

STRING STRETCHER FOR STRINGED INSTRUMENTS

FIELD OF THE INVENTION

The invention relates generally to a string stretcher for individually stretching the strings of a stringed instrument. More particularly, the invention relates to a hand-held device for pre-stretching each string at multiple locations along the string to minimize the need for subsequent re-tuning.

BACKGROUND

A stringed instrument such as a guitar has multiple strings supported in tension above a fingerboard. Each string is typically strung from the bridge at one end of the instrument, longitudinally across the fingerboard and over the "nut" at the end of the fingerboard opposite the bridge, and to a respective tuning peg, which can be rotated to adjust string tension. Tuning the instrument involves tensioning each string to a desired vibration frequency or "note".

Strings are typically made of materials such as metal and nylon that can permanently elongate under tension, which is a process known as plastic deformation. New strings quickly go out of tune because they plastically deform or "stretch," with a corresponding decrease in tension. Thus, it is common practice to vigorously "pre-stretch" a newly-installed set of strings by hand, to work-harden the strings and make them resistant to further elongation and de-tuning.

A string is properly pre-stretched by grasping it between the thumb and forefinger of each hand, with the hands spaced apart a short distance. One hand applies a force to the string in one direction across the fingerboard while the other hand simultaneously pulls the string in the opposite direction. The motion is repeated at multiple locations along the string to incrementally stretch the string across its entire length. This balanced "push-pull" technique coupled with a short hand spacing desirably minimizes lateral string displacement during stretching, as compared with simply pulling the string in one direction across or away from the fingerboard, which could damage the bridge or the nut groove in which the string is seated.

Strings are usually quite thin, and some can feel almost sharp to the touch. Although a regularly practicing musician develops sufficient finger calluses to comfortably withstand normal playing, it can be painful and tedious to pre-stretch strings with bare hands. Furthermore, pre-stretching by hand does not fully uniformly stretch the string along its entire length, because force is applied at a finite number of locations along each string. A string-stretching device is therefore desirable, to more uniformly stretch strings and to prevent the pain and discomfort of stretching by hand.

Few string-stretching devices are currently available on the market. One device currently marketed under the name PLANET WAVES™ is a multi-function peg-winder tool. The device includes a "string stretcher," which, as best understood, is essentially a single arcuate recess incorporated into the handle for receiving a selected string. The user can pull on the string using the handle, rather than by grasping the string directly by hand. A drawback is the device only applies a force in one direction, and does not replicate the more effective push-pull method described above.

Another device with potential use as a string stretcher is disclosed in U.S. Pat. No. 6,107,556 to Gilliam. A string is threaded between a pair of string guides. The device is leveraged against the fingerboard of the guitar by pushing downward on a handle toward the fingerboard to pivot the device in a plane oriented perpendicularly to the fingerboard. This places the string in tension to pre-stretch the string and to facilitate winding of the string onto the tuning pegs. Although the Gilliam device may desirably impose a push-pull force on the string between the string guides, it has several drawbacks that make it non-ideal for use as a string stretcher:

(1) Because the strings are stretched in a vertical direction rather than a more desirable lateral direction, the strings are pulled drastically upward away from the fingerboard. Pulling up this far on a string can unseat the string from the nut. Undesirable upward forces may also be exerted against the bridge, which ordinarily secures the strings at the other end of the guitar.

(2) Potentially harmful downward forces are exerted on the fingerboard, which is often made of expensive woods and may have a delicate finish.

(3) The device requires an awkward balancing of its rather narrow edge against the fingerboard while being forcibly pivoted by one hand.

(4) While one hand operates the device, another hand must simultaneously operate the tuning pegs to wind the string. Winding a string onto a tuning peg, however, often requires two hands—one hand to turn the tuning peg and another hand to hold and guide the string very close to the tuning peg as it is wound. With two hands occupied at the tuning pegs, it may be nearly impossible for a single person to simultaneously operate the device.

(5) Because the device is leveraged against the fingerboard, it may be difficult or impossible to position the device to stretch the outermost strings, which are typically very close to the edge of the fingerboard. Because few string stretchers are available on the market, and because currently available devices are limited in their ability to properly stretch strings, an improved string stretcher is clearly desirable.

Because few string stretchers are available on the market, and because currently available devices are limited in their ability to properly stretch strings, an improved string stretcher is clearly desirable.

SUMMARY OF THE INVENTION

A string stretcher is disclosed for individually stretching a selected one of a plurality of strings of a stringed instrument having a generally planar fingerboard and supporting the plurality of strings substantially parallel to the fingerboard. The string stretcher has a body with a stretcher axis of rotation positionable transverse to the fingerboard about which to rotate the string stretcher when the stretcher axis of rotation is so positioned. At least one support member is secured to the body having a respective at least one upwardly facing support surface for selectively urging and holding the selected string above the fingerboard. A first stretching member is secured to the body having a first stretching surface spaced from the stretcher axis of rotation for contacting the selected string at a first string location to urge the selected string across the fingerboard in a first direction during rotation. A second stretching member is secured to the body having a second stretching surface oppositely facing with respect to the first stretching surface, for contacting the selected string at a second string location opposite the stretcher axis of rotation from the first stretching surface to urge the selected string across the fingerboard in a second direction substantially opposite the first direction. A string access opening between the first and second stretching members allows a straight-line path for the selected string between the first and second stretching surfaces. A handle fixed to the body is spaced above the at least one upwardly facing support surface when the stretcher axis of rotation is so positioned, such that the plurality of strings does not interfere with movement of the handle during rotation.

A single support member may be positioned between the first and second stretching members. Alternatively, a first support member may be included adjacent the first stretching member and a second support member may be included adjacent the second stretching member. The first stretching member may have a first upwardly facing support surface and the second stretching member may have a second upwardly facing support surface. The first support surface may extend from the first stretching surface and the second support surface may extend from the second stretching surface.

In other embodiments, a first pulley is rotatably secured to the body and has a first pulley axis of rotation oriented substantially parallel to the stretcher axis of rotation. The first pulley has a radially inward portion including the first stretching member and a radially outward portion including the first support member. The first pulley has a radially inward surface extending from the radially inward portion to the radially outward portion to include both the first stretching surface and the first upwardly facing support surface. A second pulley is rotatably secured to the body and has a second pulley axis of rotation oriented substantially parallel to the stretcher axis of rotation. The second pulley has a radially inward portion including the second stretching member and a radially outward portion including the second support member. The second pulley has a radially inward surface extending from the radially inward portion to the radially outward portion to include both the second stretching surface and the second upwardly facing support surface.

In still other embodiments, the string stretcher comprises a first sleeve having a generally circular outer surface defining the first stretching surface and a respective first sleeve axis of rotation substantially parallel to the stretcher axis of rotation. The second stretching member comprises a second sleeve having a generally circular outer surface defining the second stretching surface and a respective second sleeve axis of rotation substantially parallel to the stretcher axis of rotation.

The foregoing is intended to summarize the invention, and is not intended to fully define nor limit the invention. The invention will be more fully understood and better appreciated by reference to the following description and drawings.

DETAILED DESCRIPTION OF PREFERRED EMBODIMENTS

Figure 1:
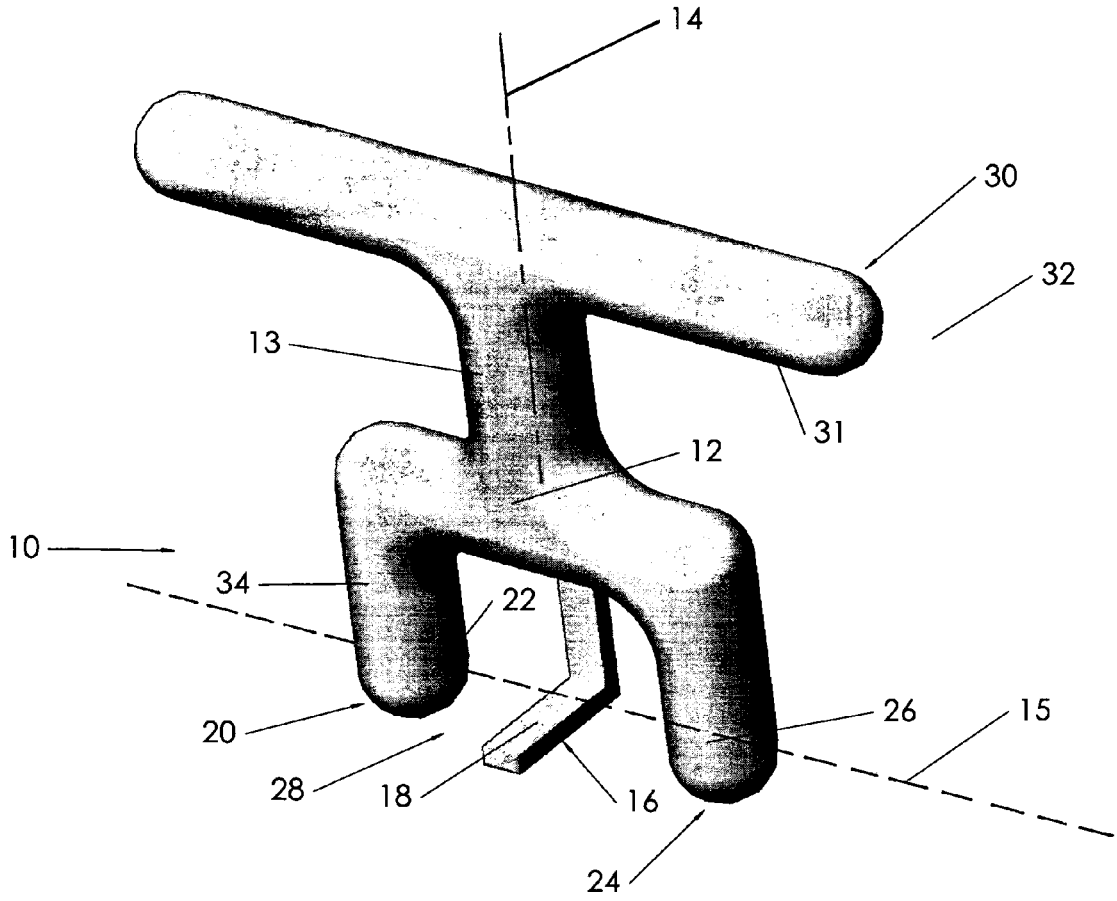
FIG. 1 conceptually shows a basic embodiment of a string stretcher having a single support member.
Figure 7:
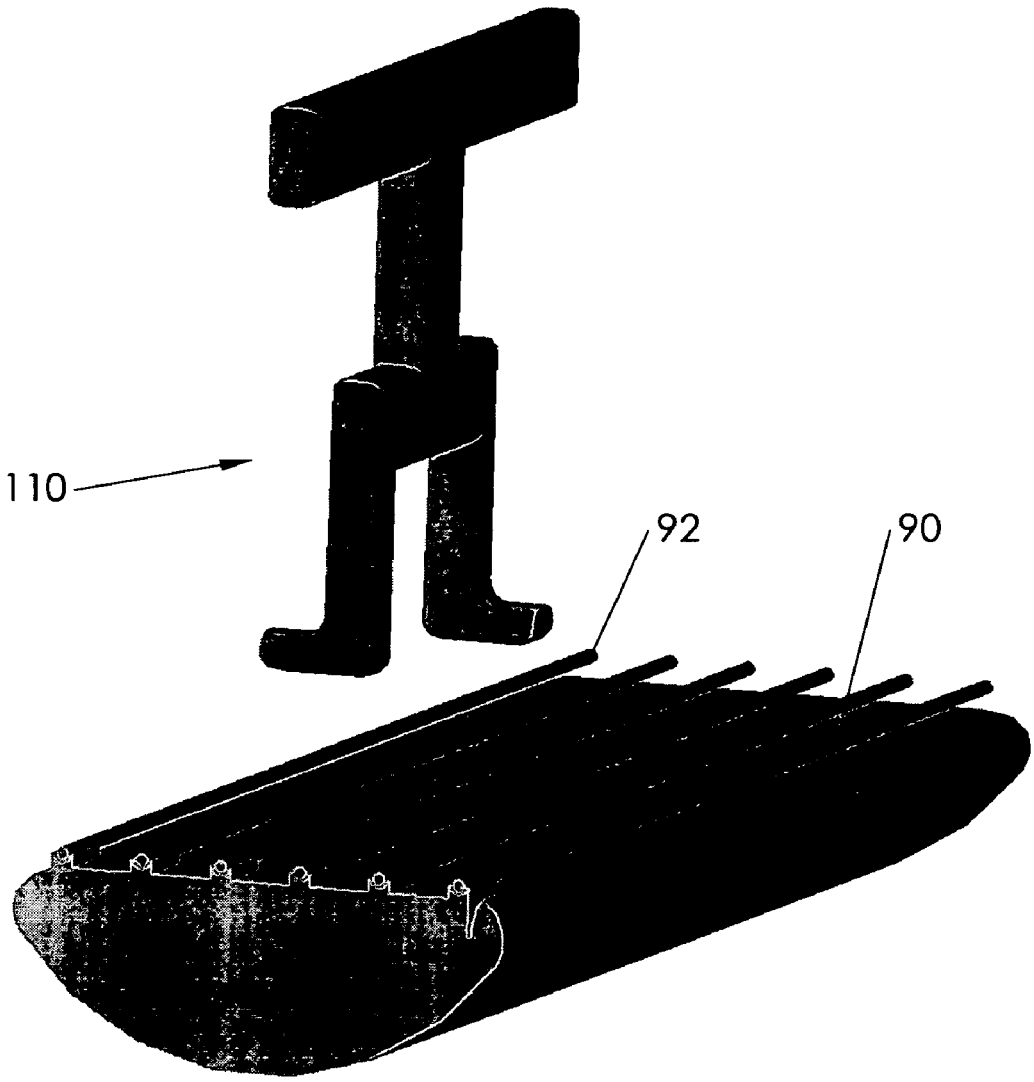
FIG. 7 conceptually shows the stretcher embodiment of FIG. 2 in a non-stretching juxtaposition to a portion of a stringed instrument having a generally planar fingerboard and a plurality of strings supported substantially parallel thereto.

FIG. 1 shows a simple conceptual embodiment of a string stretcher 10 for individually stretching a selected one of a plurality of strings 92 of a stringed instrument, a portion of which is shown conceptually in FIG. 7. The stringed instrument has a generally planar fingerboard 90 and supports the plurality of strings 92 substantially parallel to the fingerboard 90. In practice, fingerboards generally have a slight curvature and thus are often not literally planar. Likewise, strings typically have at least a slight angle with respect to the "plane" of the fingerboard, and are often not truly parallel. This description, however, suffices for the purpose of describing the principle of operation of the invention.

The string stretcher 10 comprises a body 12 having a stretcher axis of rotation 14 about which to rotate the string stretcher 10 with the stretcher axis of rotation 14 positioned transverse to the fingerboard 90. A single support member 16 is fixed to the body 12 having a respective at least one upwardly facing support surface 18 for selectively urging and holding the selected string above the fingerboard. The support member 16 may inserted below the selected string (represented by dashed line 15 in FIG. 1) at a selected location along the string 15, and the stretcher 10 may be lifted slightly upwardly (not shown) to elevate the string 15 at the selected location slightly above neighboring strings. A first stretching member 20 is fixed to the body 12 and has a first stretching surface 22 spaced from the stretcher axis of rotation 14 for contacting the selected string 15 at a first string location to urge the selected string across the fingerboard 90 in a first direction during rotation. A second stretching member 24 is fixed to the body 12 and has a second stretching surface 26 oppositely facing with respect to the first stretching surface 22, for contacting the selected string 15 at a second string location opposite the stretcher axis of rotation 14 from the first stretching surface 22 to urge the selected string 15 across the fingerboard 90 in a second direction opposite the first direction. The support member 16 is positioned between the first and second stretching members 20, 24. A string access opening 28 between the first and second stretching members 20, 24 allows a straight-line path for the selected string 15 between the first and second stretching surfaces 22, 26. A handle 30 is fixed to the body 12. The entire handle 30 is spaced above the at least one upwardly facing support surface 18 when the stretcher axis of rotation 14 is positioned transverse to the fingerboard 90, such that the plurality of strings 92 does not interfere with movement of the handle 30 during rotation.

As oriented in FIG. 1, the string 15 is routed behind the first stretching member 20, over the support member 16, and in front of the second stretching member 24. The user pulls up slightly on the handle 30 as described to provide clearance for the string 15 to be stretched. The user then uses the handle 30 to rotate the string stretcher 10 clockwise about the stretcher axis of rotation 14. The first stretching surface 22 thereby applies a force to the string 15 in one direction laterally across the fingerboard 90, and the second stretching surface 26 applies a substantially oppositely directed force to the string 15, to stretch the string 15. The user can then translate the string stretcher 10 to a different location along the selected string 15 or to another string, to stretch each string at different locations. This stretching action applied to the string 15 is desirably similar to the method described above of stretching by hand, whereby one hand pushes and the other hand pulls.

Figure 2:
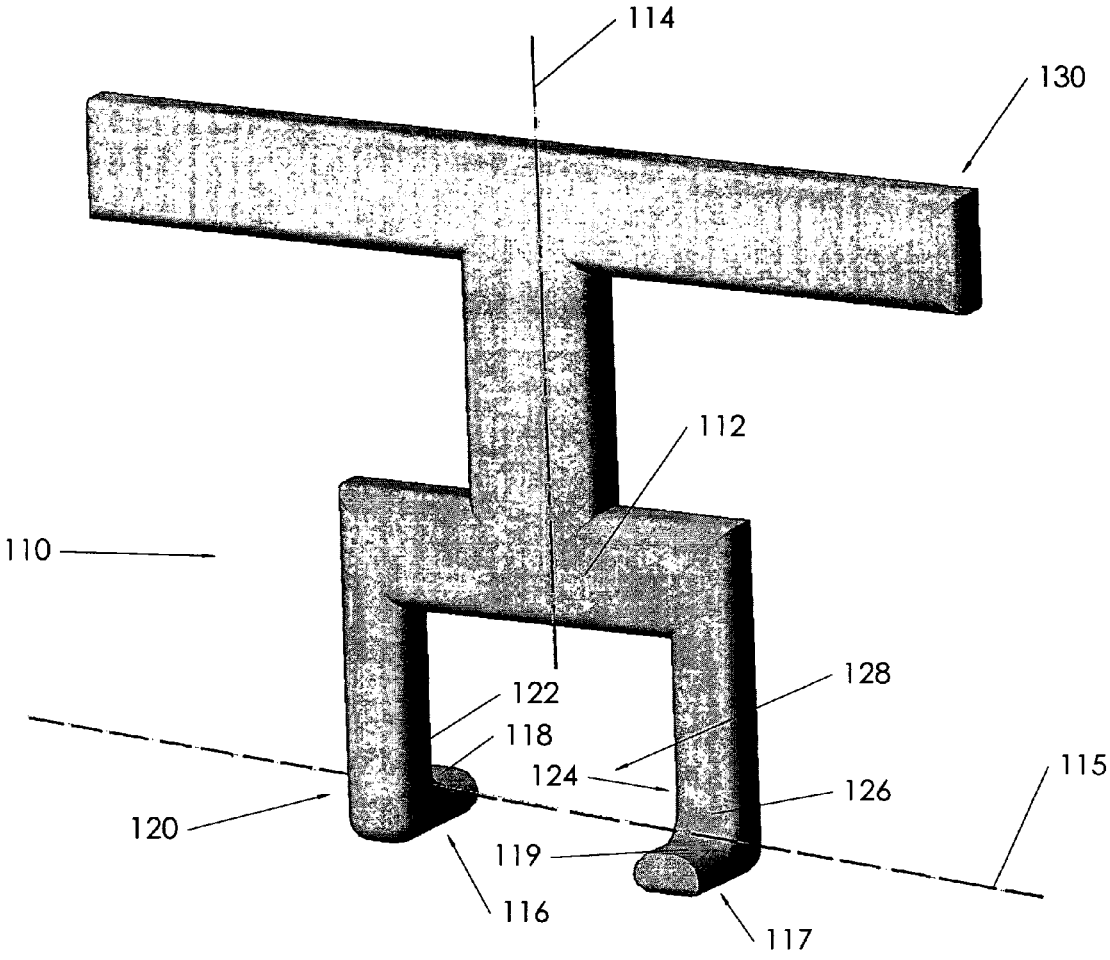
FIG. 2 conceptually shows an alternate embodiment of a string stretcher having both a first and second support member wherein the first support surface extends from the first stretching surface and the second support surface extends from the second stretching surface.

FIG. 2 conceptually shows an alternate embodiment of a string stretcher 110. Components of the embodiment of FIG. 2 that correspond with those of the embodiment of FIG. 1, and function in the same or similar manner, have been accorded reference characters that are greater by 100 than the corresponding reference characters used in FIG. 1. Rather than having a single support member, the string stretcher 110 instead has both a first and second support member 116, 117. The first support member 116 is adjacent to and extends from a first stretching member 120, and the second support member 117 is adjacent to and extends from a second stretching member 124. The first support member 116 includes a first upwardly facing support surface 118 and the second support member 117 includes a second upwardly facing support surface 119. As shown, the first support surface 118 preferably extends from the first stretching surface 122 and the second support surface 119 extends from the second stretching surface 126. In other embodiments (not shown), the surfaces 118, 119 need not extend respectively from surfaces 122, 126—for example, if the support member 116, 117 were adjacent to but slightly inward from the respective stretching members 120, 124.

As shown in FIG. 2, a string represented by dashed line 115 is routed over the first and second support surfaces 118, 119, passing behind the first stretching member 120 and in front of the second stretching member 124. The user pulls up slightly on the handle 130 as described previously to provide clearance for the string 115 to be stretched. The user then uses the handle 130 to rotate the string stretcher 110 clockwise about the stretcher axis of rotation 114. The first stretching surface 122 thereby applies a force to the string 115 in one direction laterally across the fingerboard 90, and the second stretching surface 126 applies a substantially oppositely directed force to the string 115, to stretch the string 115. As with the embodiment of FIG. 1, the user can then translate the string stretcher 110 to a different location along the selected string 115 or another string, to stretch each string at different locations.

Figure 3:
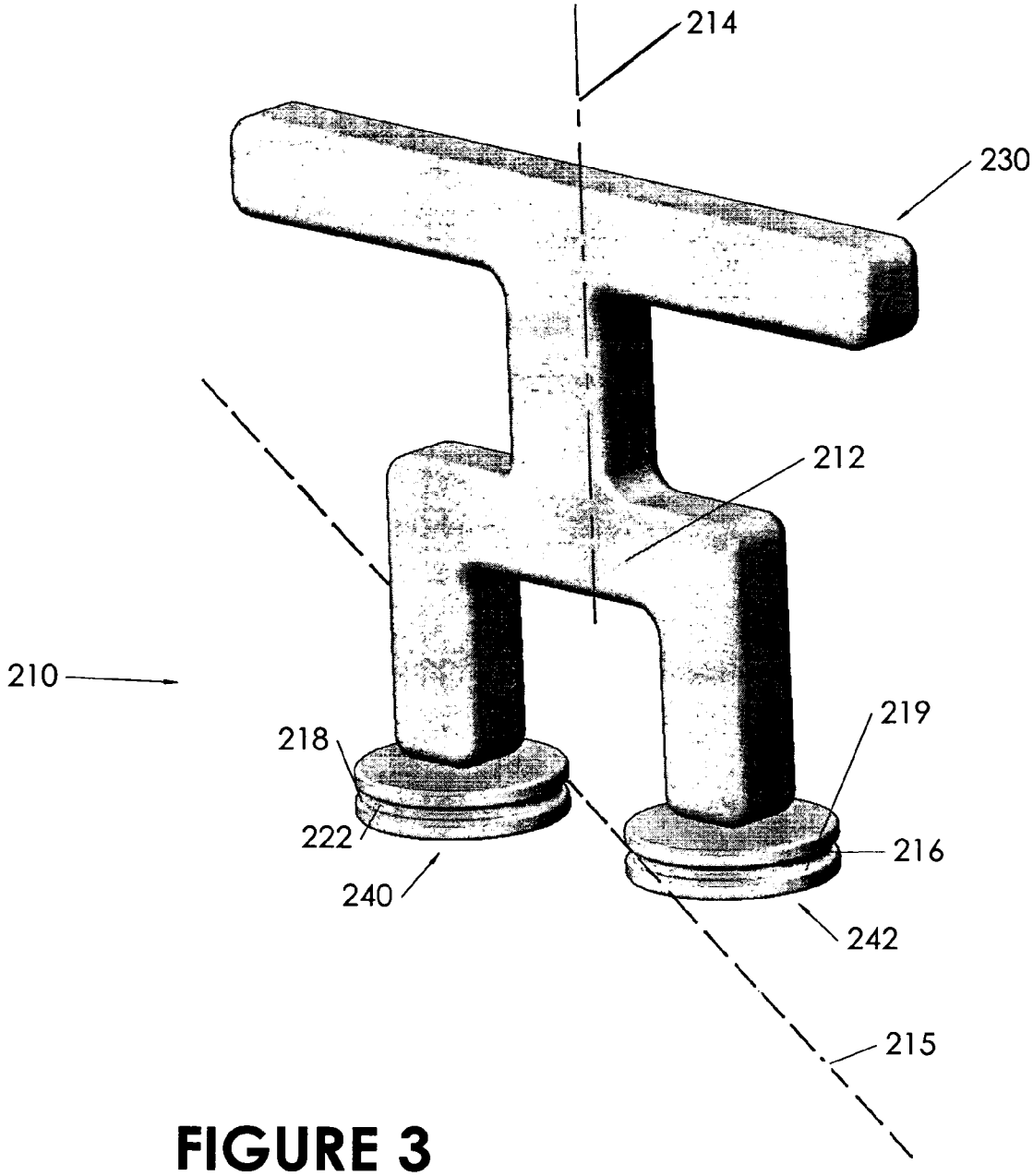
FIG. 3 conceptually shows a more preferred embodiment of a string stretcher having a pair of pulleys, with each pulley attached to a leg and providing a support surface and a stretching surface.
Figure 8:
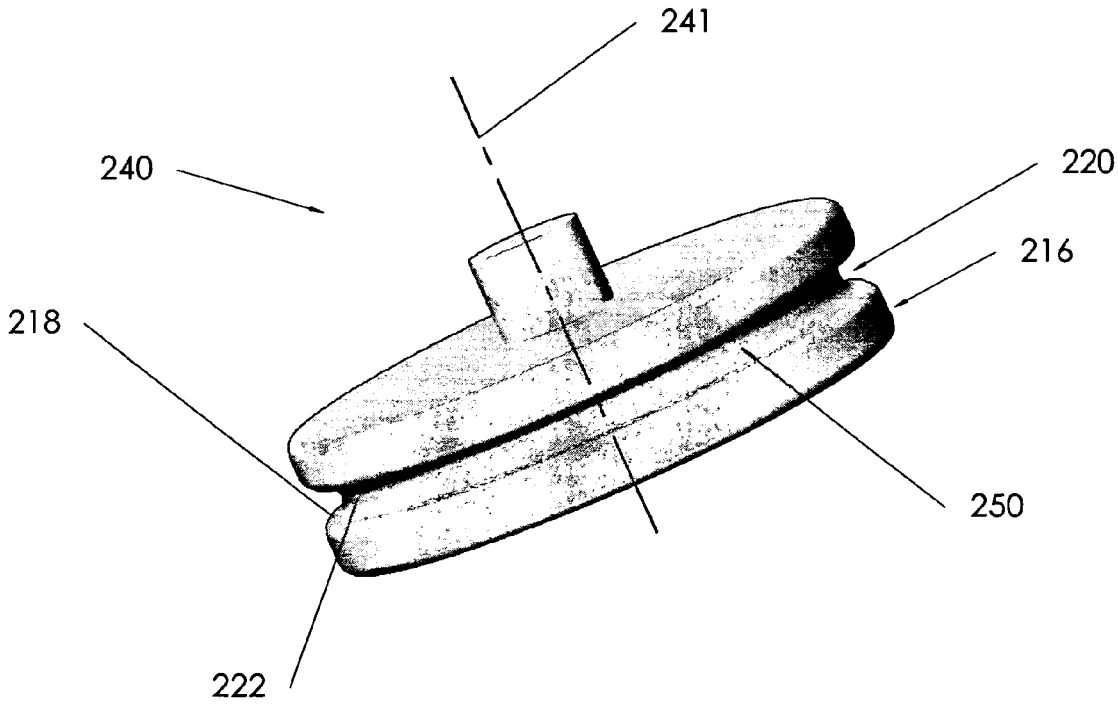
FIG. 8 shows a conceptual view of one of the pulleys in closer detail.

FIG. 3 conceptually shows a more preferred alternate embodiment of a string stretcher 210. Components of the embodiment of FIG. 3 that correspond with those of the embodiment of FIGS. 1 and 2, and function in the same or similar manner, have been accorded reference characters that are greater by 100 than the corresponding reference characters used in FIG. 2. The stretcher 210 includes a first pulley 240 rotatably secured to body 212, illustrated in greater detail in FIG. 8. The first pulley 240 has a first pulley axis of rotation 241 oriented substantially parallel to the stretcher axis of rotation 214. The first pulley 240 has a circumferential groove 250. A first stretching member 220 is a radially inward portion of the first pulley 240. A first support member 216 is a radially outward portion of the first pulley 240. The groove 250 forms a radially inward surface extending from the radially inward portion to the radially outward portion to include both a first stretching surface 222 and a first upwardly facing support surface 218. A second pulley 242 analogous to and spaced from the first pulley 240 is rotatably secured to the body 212 and has a second pulley axis of rotation oriented substantially parallel to the stretcher axis of rotation. The second pulley 242 includes a second stretching member and a second support member, and a radially inward surface defining both the second stretching surface 226 and the second upwardly facing support surface 219. Although the first and second stretching surfaces 222, 226 circumferentially extend 360 degrees about their respective first and second pulley axes of rotation and are pivotable about their respective axes of rotation, it may be observed that at any given rotation, the portion of the stretching surface 222 contacting the string represented by dashed line 215 is substantially oppositely facing with respect to the portion of the stretching surface 226 contacting the string 215.

One advantage of the embodiment of FIG. 3 is that the pulleys 240, 242 are free to rotate, such that while stretching the string 215, the stretcher 210 may be translated along the string to stretch the string 215 along a continuity of locations along the string 215. The pulleys 240, 242 roll along the string 215 even while torque is applied to the handle 230 to stretch the string 215. Although the embodiments of FIGS. 1 and 2 are less preferred for simultaneous stretching and translation, the stretching surfaces 22, 26, 122, 126 may be formed of low-friction materials, such that the stretcher 10, 110 may also be slid along the string while a rotating stretching force is applied. By contrast, it would be painful and possibly injurious to slide one's own fingers along the string while applying vigorous stretching forces.

Figure 4:
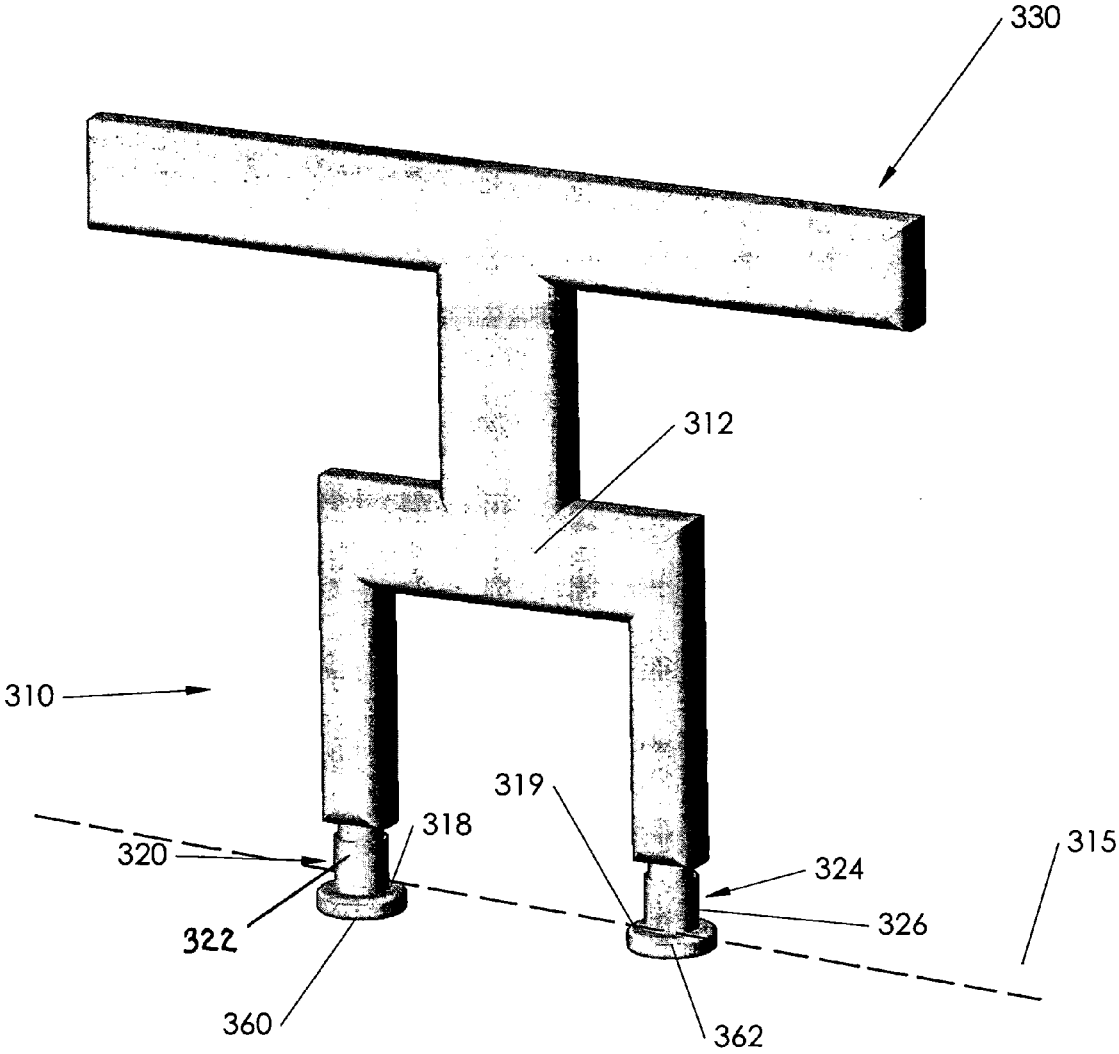
FIG. 4 conceptually shows a string stretcher wherein each stretching member comprises a sleeve.

Yet another embodiment is illustrated conceptually in FIG. 4 of a string stretcher 310. A first stretching member 320 is a first sleeve 320 having a generally circular outer surface 322 being the first stretching surface 322. The first sleeve 320 has a respective first sleeve axis of rotation substantially parallel to a stretcher axis of rotation 314. A second stretching member 324 is a second sleeve 324 having a generally circular outer surface 326 being a second stretching surface 326. The second sleeve 324 has a respective second sleeve axis of rotation substantially parallel to the stretcher axis of rotation 324. Thus, the stretcher 310 is suitable for simultaneous stretching and translation along the string 315. As with the embodiment of FIG. 3, at any given rotation, the portion of the stretching surface 322 contacting the string 315 is substantially oppositely facing with respect to the portion of the stretching surface 326 contacting the string 315. Radially outward flanges 360 and 362 retain the sleeves 320, 324 and provide upwardly facing support surfaces 318, 319.

The angular orientation of the stretching surfaces and upwardly facing support surfaces can affect the ease of use of the string stretcher. This may be illustrated with reference back to FIG. 1. The first and second stretching surfaces 22 and 26 are intended to urge the string 15 in a generally lateral direction across the fingerboard 90. Accordingly, while stretching the string 15, the stretcher axis of rotation 14 is oriented transversely and preferably perpendicularly to the fingerboard 90. With the axis of rotation 14 oriented perpendicularly to the fingerboard 90, the first and second stretching surfaces 22 and 26 are preferably each oriented at less than 30 degrees with respect to the axis of rotation 14. More preferably, the first and second stretching surfaces 22, 26 are each substantially parallel to the axis of rotation 14. Furthermore, because the upwardly facing support surface 18 is intended to lift the string 15 upwardly with respect to the fingerboard 90, it is preferably oriented at less than 30 degrees with respect to the fingerboard 90 when the axis of rotation 14 is oriented perpendicular to the fingerboard 90. More preferably, the upwardly facing support surface 18 is substantially parallel to the fingerboard 90 as shown, or extends slightly upward from the stretching surface 22 at an angle of preferably less than 15 degrees with respect to the fingerboard, such that the string 15 does not slip off the upwardly facing support surface 18.

With further reference to FIG. 1, a spacing between the handle 30 and the support member 16 can affect how easily the handle 30 may be grasped. It is also important to space the handle 30 sufficiently above the support member 16 so that the handle 30 does not interfere with any of the strings or the fingerboard 90. Therefore, the upwardly facing support surface 18 is preferably positioned at least one inch from a lower surface 31 of the handle 30, to allow clearance for the hand to grasp the handle 30 without interference with the strings or fingerboard. To facilitate rotation of the stretcher 10 about the axis of rotation 14, the handle 30 preferably extends to or passes through the stretcher axis of rotation 14. To further facilitate grasping of the handle 30, the body 12 may include a central body portion 13 having a width less than a lateral spacing between the first and second stretching members 20, 24.

Figure 5:
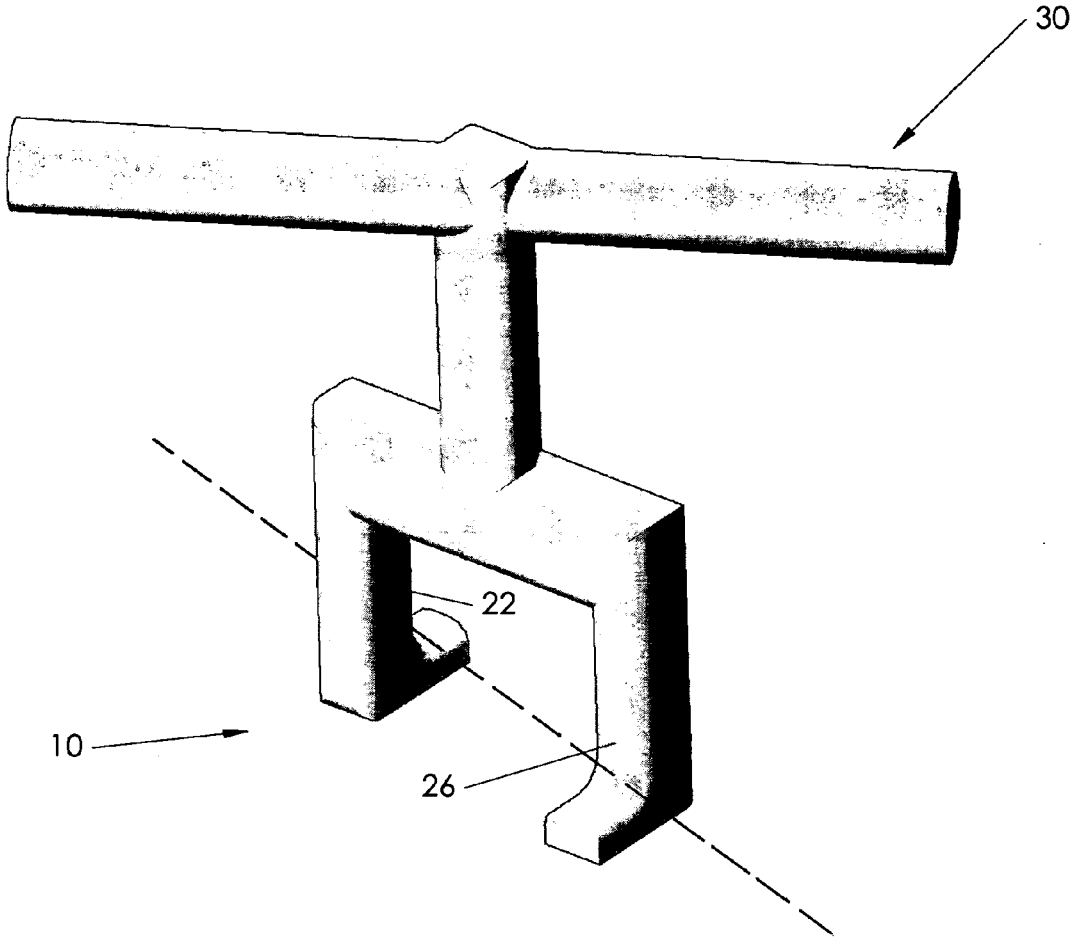
FIG. 5 conceptually shows a string stretcher having a handle angled with respect to a plane defined by the first and second stretching surfaces.

In the FIG. 1 embodiment, the first and second stretching surfaces 22, 26 define a first plane, in that at least a portion of each surface 22, 26 is tangent to the defined first plane. Likewise, central axes of the first and second stretching members may define a second plane. The first and second plane provide a reference for orientation of the handle 30. In some preferred embodiments, the handle centerline 32 is substantially parallel to the first or second defined plane. In those embodiments, the handle 30 may be substantially parallel to the string 15 under threshold (i.e. substantially non-stretching) contact of the stretching surfaces 22, 26 with the string 15. In the FIG. 1 embodiment, the handle centerline 32 is at a small angle with respect to the defined first plane, and will be at a similar angle with respect to the string 15. This angle may be selected during manufacture to provide an ergonomic advantage or to provide leverage. For example, it is common to stretch strings with a guitar on one's lap, with the fingerboard facing upwardly. In this instance, it may be easier to rotate the handle 30 if the angle is counterclockwise with respect to the string, such that the user rotates the handle 30 clockwise to stretch the string 15. The angle may alternatively be selected to provide a reference indicating a "proper" degree of stretch, such as to prevent the user from over-torquing the handle 30, which may damage the stretcher 10 or the stringed instrument. For example, the angle may be selected such that a proper degree of stretch is obtained when the handle 30 is rotated until parallel with the string 15. In some preferred embodiments, the selected angle is between 15 and 45 degrees. FIG. 5 iltustrates the handle 30 angled with respect to each of the defined first and second plane.

Figure 6:
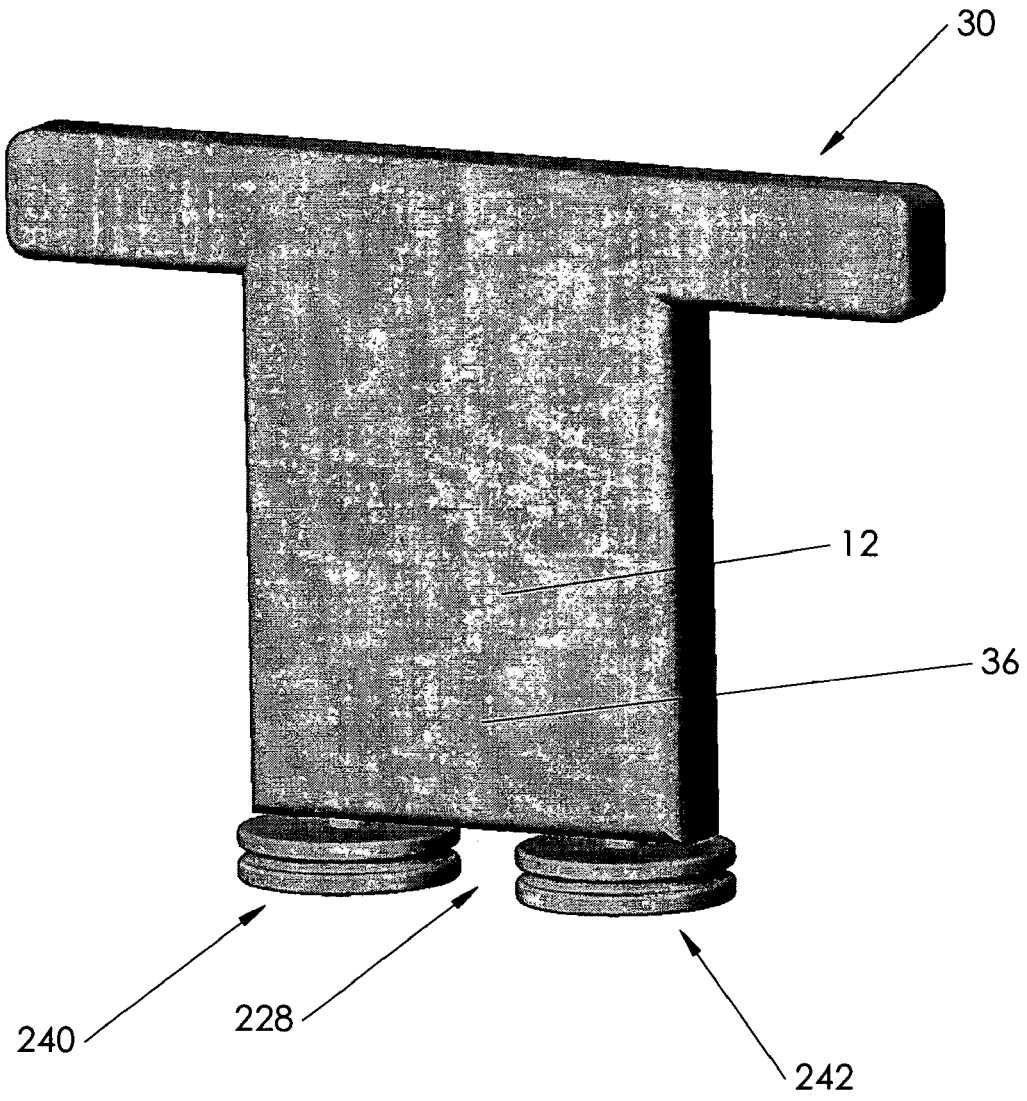
FIG. 6 conceptually shows a string stretcher having a pair of pulleys secured directly to the body, without legs.

In some embodiments, the body may include a pair of legs to which the stretching members are fixed. For example, in the embodiment of FIG. 1, a first leg 34 and second leg 35 extend transversely with respect to the handle centerline 32. The first stretching member 20 is fixed to or included with the first leg 34, and the second stretching member 24 is fixed to or included with the second leg 24. The string access opening 28 comprises a spacing between the first and second leg 34, 35. By contrast, FIG. 6 illustrates that individual legs are not required. The "legless" stretcher of FIG. 6 has a substantially continuous portion 36 that bridges the portion of the body 12 that would ordinarily be referred to as legs 34, 35 in FIG. 1. The string access channel 28 is the gap between pulleys 240, 242. An advantage of the legless stretcher is a potentially increased torsional stiffness of the body 12 while stretching a string.

Although specific embodiments of the invention have been described herein in some detail, it is to be understood that this has been done solely for the purposes of describing the various aspects of the invention, and is not intended to limit the scope of the invention as defined in the claims which follow. Those skilled in the art will understand that the embodiment shown and described is exemplary, and various other substitutions, alterations, and modifications, including but not limited to those design alternatives specifically discussed herein, may be made in the practice of the invention without departing from the invention.

The invention claimed is:

1. A string stretcher for individually stretching a selected one of a plurality of strings of a stringed instrument, the stringed instrument having a generally planar fingerboard and supporting the plurality of strings substantially parallel to the fingerboard, the string stretcher comprising:

a body having a stretcher axis of rotation about which to rotate the string stretcher with the stretcher axis of rotation positioned transverse to the fingerboard;

at least one support member secured to the body having a respective at least one upwardly facing support surface for selectively urging and holding the selected string above the fingerboard;

a first stretching member secured to the body having a first stretching surface spaced from the stretcher axis of rotation for contacting the selected string at a first string location to urge the selected string across the fingerboard in a first direction during rotation;

a second stretching member secured to the body having a second stretching surface oppositely facing with respect to the first stretching surface, for contacting the selected string at a second string location opposite the stretcher axis of rotation from the first stretching surface to urge the selected string across the fingerboard in a second direction substantially opposite the first direction; and a handle fixed to the body.

2. A string stretcher as defined in claim 1, wherein the at least one support member is positioned between the first and second stretching members.

3. A string stretcher as defined in claim 1, wherein the at least one support member includes a first support member extending from the first stretching member and a second support member extending from the second stretching member, the at least one upwardly facing support surface including a first upwardly facing support surface on the first support member and a second upwardly facing support surface on the second support member.

4. A string stretcher as defined in claim 3, wherein the first support surface extends from the first stretching surface and the second support surface extends from the second stretching surface.

5. A string stretcher as defined in claim 4, further comprising:

a first pulley rotatably secured to the body and having a first pulley axis of rotation oriented substantially parallel to the stretcher axis of rotation, the first pulley having a radially inward portion including the first stretching member and a radially outward portion including the first support member, the first pulley having a radially inward surface extending from the radially inward portion to the radially outward portion to include both the first stretching surface and the first upwardly facing support surface; and a second pulley rotatably secured to the body and having a second pulley axis of rotation oriented substantially parallel to the stretcher axis of rotation, the second pulley having a radially inward portion including the second stretching member and a radially outward portion including the second support member, the second pulley having a radially inward surface extending from the radially inward portion to the radially outward portion to include both the second stretching surface and the second upwardly facing support surface.

6. A string stretcher as defined in claim 1, wherein the first stretching member comprises a first sleeve having a generally circular outer surface defining the first stretching surface and a respective first sleeve axis of rotation substantially parallel to the stretcher axis of rotation, and the second stretching member comprises a second sleeve having a generally circular outer surface defining the second stretching surface and a respective second sleeve axis of rotation substantially parallel to the stretcher axis of rotation.

7. A string stretcher as defined in claim 1, wherein the first and second stretching surface are each substantially parallel to the stretcher axis of rotation.

8. A string stretcher as defined in claim 1, wherein the at least one upwardly facing support surface is substantially parallel to the fingerboard when the stretcher axis of rotation is oriented perpendicular to the fingerboard.

9. A string stretcher as defined in claim 1, wherein the at least one upwardly facing support surface is positioned at least one inch from a lower surface of the handle, to allow clearance for the hand to grasp the handle without interference with the fingerboard.

10. A string stretcher as defined in claim 1, wherein a handle centerline is substantially parallel to a plane defined by the first and second stretching surfaces.

11. A string stretcher as defined in claim 1, wherein a handle centerline is at a selected angle with respect to a plane defined by central axes of the first and second stretching members.

12. A string stretcher as defined in claim 11, wherein the selected angle is between 15 and 45 degrees.

13. A string stretcher as defined in claim 1, wherein the body further comprises:

a central body portion having a width less than a lateral spacing between the first and second stretching members.

14. A string stretcher as defined in claim 1, wherein the body further comprises:

a first and second leg extending transversely with respect to a handle centerline, the first stretching member fixed to the first leg, the second stretching member fixed to the second leg, the string access opening comprising a spacing between the first and second leg.

15. A string stretcher as defined in claim 1, wherein the handle extends to or passes through the stretcher axis of rotation.

16. A string stretcher for individually stretching a selected one of a plurality of strings of a stringed instrument, the stringed instrument having a generally planar fingerboard and supporting the plurality of strings substantially parallel to the fingerboard, the string stretcher comprising:

a body having a stretcher axis of rotation about which to rotate the string stretcher with the stretcher axis of rotation positioned transverse to the fingerboard;

a first pulley rotatably secured to the body and having a first pulley axis of rotation oriented substantially parallel to the stretcher axis of rotation, the first pulley including a radially outward first support member defining a first upwardly facing support surface for selectively urging and holding the selected string above the fingerboard and a radially inward first stretching member defining a first stretching surface for contacting the selected string at a first string location to urge the selected string across the fingerboard in a first direction during rotation;

a second pulley rotatably secured to the body and having a second pulley axis of rotation oriented substantially parallel to the stretcher axis of rotation, the second pulley including a radially outward second support member defining a second upwardly facing support surface for selectively urging and holding the selected string above the fingerboard and a radially inward second stretching member defining a second stretching surface oppositely facing with respect to the first stretching surface, for contacting the selected string at a second string location opposite the stretcher axis of rotation from the first stretching surface to urge the selected string across the fingerboard in a second direction substantially opposite the first direction;

a string access opening between the first and second stretching members allowing a path for the selected string between the first and second stretching surfaces; and a handle fixed to the body, the entire handle spaced above the at least one upwardly facing support surface, such that the plurality of strings does not interfere with movement of the handle during rotation.

17. A string stretcher as defined in claim 16, wherein a handle centerline is at a selected angle with respect to a plane defined by central axes of the first and second pulleys.

18. A string stretcher as defined in claim 16, wherein the pulleys are positioned at least one inch from a lower surface of the handle.

19. A string stretcher as defined in claim 1, further comprising:

a string access opening between the first and second stretching members allowing a path for the selected string between the first and second stretching surfaces.

20. A string stretcher as defined in claim 1, wherein the entire handle is spaced above the at least one upwardly facing support surface, such that the plurality of strings does not interfere with movement of the handle during rotation.

21. A method of stretching strings of a stringed instrument, the stringed instrument having a generally planar fingerboard, the stringed instrument supporting the plurality of strings substantially parallel to the fingerboard, the method comprising:

selecting a string;

positioning a body with a stretcher axis of rotation transverse to the fingerboard;

positioning at least one support member between the fingerboard and the selected string, the at least one support member being secured to the body and having a respective at least one upwardly facing support surface;

moving the body upward relative to the fingerboard to engage the selected string with the at least one upwardly facing support surface to urge and hold the selected string above an adjacent string;

positioning a first stretching member adjacent the selected string at a first string location spaced from the stretcher axis of rotation, the first stretching member having a first stretching surface for contacting the selected string, the first stretching member secured to the body;

positioning a second stretching member adjacent the selected string at a second string location spaced from the stretcher axis of rotation and substantially opposite the stretcher axis of rotation from the first stretching surface, the second stretching member having a second stretching surface oppositely facing with respect to the first stretching surface for contacting the selected string; and rotating the body about the stretcher axis of rotation to urge the string at the first string location laterally across the fingerboard in a first direction and to simultaneously urge the selected string at the second string location laterally across the fingerboard in a second direction substantially opposite the first direction, to stretch the selected string.

22. A method as defined in claim 21, wherein rotating the body about the stretcher axis of rotation comprises rotating a handle secured to the body.

23. A method as defined in claim 22, wherein the handle has a handle centerline at a selected angle with respect to a plane defined by central axes of the first and second stretching members, and rotating the body about the stretcher axis of rotation comprises rotating the handle to align the handle substantially parallel to the selected string.

24. A method as defined in claim 21, further comprising:

moving the body along the string while the body is rotated, to stretch the selected string at a plurality of locations.

25. A method as defined in claim 21, wherein the at least one support member and the first and second stretching members are included on two or more pulleys.

* * * * *